United States Patent [19]

Tanaka et al.

[11] Patent Number: 4,939,321

[45] Date of Patent: Jul. 3, 1990

[54] PRESSURE SWITCH WITH LAMINATED DIAPHRAGM

[75] Inventors: Hazime Tanaka, Yokohama; Keiji Sasaki, Tokyo; Hirayoshi Suzuki, Hadano, all of Japan

[73] Assignee: Fuji Koji Manufacturing Co., Ltd., Tokyo, Japan

[21] Appl. No.: 347,995

[22] Filed: May 5, 1989

[30] Foreign Application Priority Data

May 11, 1988 [JP] Japan ..... 63-113864

[51] Int. Cl.[5] ..... H01H 35/34

[52] U.S. Cl. ..... 200/83 P; 200/83 J; 200/302.1

[58] Field of Search ..... 337/117, 320; 200/83 R, 200/83 P, 83 B, 83 W, 83 J, 83 N, 83 Y, 81.4, 81.5, 302.1; 307/118; 340/626; 91/1; 92/5 R; 73/717, 723, 745

[56] References Cited

U.S. PATENT DOCUMENTS

| | | | |
|---|---|---|---|
| 3,584,164 | 6/1971 | Wagner | 200/16 B |
| 3,585,328 | 6/1971 | Fiore | 200/83 Y |
| 3,816,685 | 6/1974 | Fiore | 200/83 R |
| 4,091,249 | 5/1978 | Huffman | 200/83 P |
| 4,243,858 | 1/1981 | Place | 200/83 P |
| 4,459,444 | 7/1984 | Charboneau | 200/83 P |
| 4,591,677 | 5/1986 | Hirota et al. | 200/83 J |
| 4,593,166 | 6/1986 | Hirota | 200/81.4 |
| 4,667,069 | 5/1987 | Cholkeri | 200/83 P |
| 4,820,890 | 4/1989 | Tamura et al. | 200/81.4 |
| 4,827,094 | 5/1989 | Tanaka et al. | 200/83 |
| 4,853,504 | 8/1989 | Tanaka | 200/83 J |

OTHER PUBLICATIONS

Brochure entitled "Automobile Air-Conditioning Parts", by Fuji Koki Manufacturing Co., Ltd., 15 pages.

*Primary Examiner*—Gerald P. Tolin

*Attorney, Agent, or Firm*—Brown, Martin, Haller & McClain

[57] ABSTRACT

A pressure switch includes a housing, the inner space of which is divided into a pressurized fluid operating chamber and a switch mechanism chamber by a flexible diaphragm. The operating chamber communicates with a pressurized fluid inlet hole, and the mechanism chamber houses a switch mechanism. The diaphragm is hermetically fixed to the inner surface of the housing by an elastic seal member. The switch mechanism has a spring for urging the diaphragm toward the operating chamber. The switch mechanism is turned on or off as the diaphragm is transformed against the urging force of the spring by the pressure of a fluid introduced through the inlet hole into the operating chamber. The diaphragm is constructed by stacking a metal film and a flexible plastic film in layers so that the films are independent of each other. The diaphragm, whose peripheral edge is fixed to the inner surface of the inner space is so located that the metal film faces the operating chamber and the plastic film faces the mechanism chamber. The respective thicknesses of the metal film and the plastic film are so set that stress produced in the metal film when the metal film is elastically transformed by the transformation of the diaphragm is smaller than stress produced in the plastic film when the plastic film is elastically transformed by the transformation of the diaphragm.

11 Claims, 3 Drawing Sheets

PRESSURE SWITCH WITH LAMINATED DIAPHRAGM

BACKGROUND OF THE INVENTION

1. Field of the Invention

The present invention relates to a pressure switch which is used for ON-OFF control of an electric circuit in response to a predetermined pressure.

2. Description of the Related Art

Pressure switches of various types are widely used in, for example, refrigeration systems. Well-known switch types include high- and low-pressure-cut off types, high- and low-pressure-on types, double-action type, and triple-action type. The high-pressure-cut off type serves to cut off a certain device in the refrigeration system from the power supply when the pressure of a refrigerant in the system exceeds a predetermined level. The low-pressure-cut off type serves to cut off a certain device in the refrigeration system from the power supply when the pressure of the refrigerant is reduced below a predetermined level. The high- and low-pressure-on types acts reversely in comparison with above described two cut off types. The double-action type serves to turn on or off a certain device within a predetermined range of refrigerant pressure. The triple-action type serves to turn on or off two devices within two different predetermined ranges of refrigerant pressure.

The pressure switches of the high-pressure-cut off type are used, for example, to cut off a compressor from the power supply when the pressure of the refrigerant in a refrigeration system exceeds the predetermined level. The pressure switches of the high-pressure-on type are used, for example, in a refrigeration system having a condenser with a cooling fan to turn on the cooling fan of the condenser of the refrigeration system when the pressure and temperature of the refrigerant in the system exceed predetermined levels.

FIG. 1 schematically shows an arrangement of a typical conventional pressure switch of the low-pressure-cut off type. This type of switches are on the market by the assignee of this application. In FIG. 1, the inner space of housing 10 is divided into two compartments by means of diaphragm 12, which is formed of a flexible polyimide film. One of the compartments serves as pressurized fluid operating chamber 16 which communicates with pressurized fluid inlet hole 14, while the other compartment serves as switch mechanism chamber 18. In chamber 18, movable terminal supporting member 20 is pressed against diaphragm 12 by urging means 22, so that supporting member 20 is located in an OFF position where it is away from fixed terminals 24 in chamber 18. As the pressure of a pressurized fluid introduced into pressurized fluid operating chamber 16 overcomes the urging force of urging means 22, supporting member 20 is moved to an ON position where movable terminal 26 is pressed on fixed terminals 24.

FIG. 2 schematically shows an arrangement of a typical conventional pressure switch of the double-action type constructed by combining the construction for the low-pressure-cut off type described above and the construction for the high-pressure-cut off type. This type of switches are widely known by U.S.P. 4,593,166. In FIG. 2, snap disk supporting member 30 in switch mechanism chamber 18 is pressed against diaphragm 12 by urging means 22. Snap disk 32 is disposed in a tray-shaped depression on the diaphragm-side end face of supporting member 30, and projects at its center portion toward diaphragm 12. Movable terminal driving projection 34, which is fixed on the central portion of disk 32, penetrates supporting member 30. The projecting end of driving projection 34 faces movable terminal 36, which extends along the urging-means-side end surface of supporting member 30 in switch mechanism chamber 18 and is located at its OFF position where it is away from fixed terminals 24. When the pressure of the pressurized fluid introduced into pressurized fluid operating chamber 16 exceeds a first predetermined level, supporting member 30 is moved downward against the urging force of urging means 22 to press movable terminal 36 to its 0N position where its is pressed on fixed terminal 24. When the pressure further rises and exceeds a second predetermined level, snap disk 32 is transformed to project its center portion toward the bottom surface of the tray-shaped depression on the diaphragm-side end surface of snap disk supporting member 30. Thus, the projecting end of movable terminal driving projection 34 presses movable terminal 36, thereby moving it to an OFF position where it is away from fixed terminal 24.

Polyimide-film diaphragm 12, which is used in the two prior art examples described above, has best mechanical properties for use in pressure switches. The polyimide film, however, is preamble to some of various refrigerants used in various refrigeration systems, so that the pressure switches having the polyimide-film diaphragm can be used only in a refrigeration system employing a refrigerant permeability of which to diaphragm 12 is too little to arise a problem on practical use, e.g., a car air conditioner which employs the R12 as a refrigerant.

Recently has been raised, however, the problem of destruction of the ozone layer in the atmosphere by fron gas (especially, chlorofluorocarbon). Accordingly, a restriction of the manufacture and sale of refrigerants R11, R12, R113, R114, and R115, which are composed mainly of chlorofluorocarbon, have started on a worldwide scale. It has been proposed that the R22, R134 or a fluid produced by mixing R500 and any other components should be used as the refrigerant for the future. Thus, when those refrigerants which are composed mainly of chlorofluorocarbon are used, it is strictly required to hermetically seal it.

If the aforementioned pressure switch, employing polyimide-film diaphragm 12 which has high permeability to all the refrigerants except the R12, are used in these circumstances, the refrigerant may leak from the refrigeration system unless switch mechanism chamber 18 of housing 10 is hermetically sealed. If chamber 18 is hermetically sealed, however, the switch mechanism in chamber 18, which is adapted to be operated by the difference in pressure between chamber 18 and pressurized fluid operating chamber 16 divided by diaphragm 12, is prevented from operating normally.

FIG. 3 schematically shows an arrangement of a pressure switch conventionally used in a refrigeration system which employs the R22, R502, or R500 as a refrigerant. This type of switches are widely known by U.S.P. 3,584,164, and are on the market by the assignee of this application.

In this pressure switch, diaphragm 40 is formed of a metal sheet, and its peripheral edge is welded to the inner surface of the inner space of housing 10. Such diaphragm 40 elastically deforms to project at its center portion toward switch mechanism chamber 18 when the pressure of a fluid introduced into pressure fluid operating chamber 16 in housing 10 exceeds a predetermined level. Thereupon, movable terminal driving projection 42 fixed to the lower surface of diaphragm 40 moves movable terminal 44 from its ON position, where it presses on fixed terminal 24, to its OFF position, where it is away from the fixed terminal 24. When the fluid pressure inside chamber 16 is lowered to a pressure level not higher than the predetermined level, diaphragm 40 is restored, by its own elastic force, to its initial configuration, so that it projects at its center portion toward pressure fluid operating chamber 16. The pressure switch of this construction has an advantage in its quick switching operation, and can be effectively used in a refrigeration system which employs the refrigerant under a relatively high pressure.

In the pressure switch constructed in this manner, however, diaphragm 40 is distorted by heat which is produced while the peripheral edge of the diaphragm is being welded. In a final process of the manufacture of the switch, therefore, changing in the operating performance of diaphragm 40, due to the thermal distortion, must be corrected. Moreover, the welding work is complicated, and therefore, entails an increase in the manufacturing costs of the pressure switch. And, the pressure switch of this construction has a difficulty to construct the double-action type pressure switch as shown in FIG. 2 and the triple-action type pressure switch.

SUMMARY OF THE INVENTION

The present invention has been contrived in consideration of these circumstances, and its object is to provide a pressure switch which can be easily manufactured and assembled despite the use of a diaphragm without permeability to gas, and also provide a pressure switch of multi action type.

In order to achieve the above object, a pressure switch according to the present invention comprises: a housing having an inner space and a pressurized fluid inlet hole for communicating the inner space with the outside space; a switch mechanism disposed in the inner space of the housing; a flexible diaphragm disposed between the pressurized fluid inlet hole and the switch mechanism in the inner space of the housing to divide the inner space into a pressurizing fluid operating chamber, communicating with the pressurized fluid inlet hole, and a switch mechanism chamber, containing the switch mechanism and not communicating with the pressurized fluid inlet hole; and an elastic seal member disposed in the inner space and hermetically fixing the peripheral edge of the diaphragm to the inner surface of the inner space of the housing. In this pressure switch, the switch mechanism includes urging means for urging the diaphragm toward the pressurized fluid operating chamber. The switch mechanism is turned on or off as the diaphragm is transformed against the urging force of the urging means by means of the pressure of a fluid introduced through the pressurized fluid inlet hole into the pressurized fluid operating chamber. The diaphragm is constructed by stacking a metal film and a flexible plastic film in layers so that the films are independent of each other. The diaphragm, whose peripheral edge is fixed to the inner surface of the inner space of the housing, is so located that the metal film faces the pressurized fluid operating chamber and the plastic film faces the switch mechanism chamber. The respective thicknesses of the metal film and the plastic film are so set that stress produced in the metal film when the metal film is elastically transformed by the transformation of the diaphragm is smaller than stress produced in the plastic film when the plastic film is elastically transformed by the transformation of the diaphragm.

In the pressure switch of the invention characterized by the construction as described above, the elastic seal member and the metal film of the diaphragm airtightly partition the pressurized fluid operating chamber and the switch mechanism chamber in the inner space of the housing. Since the fluid pressure applied to the metal film in the pressurized fluid operating chamber is transmitted through the plastic film to the urging means of the switch mechanism, the metal film is not damaged by the pressure. Also, this fluid pressure continually ensures the integrity of the laminated structure of the metal film and the plastic film. Accordingly, the metal film can always transforms integrally with the plastic film, so that it can be securely prevented from being cracked due to a difference between the transformations of the two films. The use of the elastic seal member to fix the peripheral edge of the diaphragm to the inner surface of the inner space of the housing greatly facilitates the manufacture and assembly of the pressure switch, as compared to the conventional diaphragm fixing method by means of welding.

Preferably, in the pressure switch constructed in this manner, friction reducing means for reducing friction between the metal film and the plastic film is disposed between the two films. To attain this, it is more preferable that the plastic film is formed of a polyimide film, the friction reducing means is formed of a polytetrafluoroethylene film, and the polytetrafluoroethylene film is sandwiched between the metal film and the polyimide film.

The aforementioned specific requirement on the respective thicknesses of the metal film and the plastic film of the diaphragm can be fulfilled by making the ratio between the thicknesses of the two films smaller than the inverse number of the cube root of the ratio between the respective modulus of longitudinal elasticity of the films.

Preferably, moreover, the housing includes first and second half portions, the first half portion having the pressurized fluid inlet hole and an inner space communicating with the inlet hole and opening at one end, the inner space of the first half portion constituting the pressurized fluid operating chamber, and the second half portion having an inner space open at one end and constituting the switch mechanism chamber; and the elastic seal member, supporting the peripheral edge of the diaphragm, is sandwiched between the respective open ends of the first and second half portions, and the elastic seal member is fixed on the inner surface of the inner space of the housing between the pressurized fluid operating chamber and the switch mechanism chamber by connecting the first and second half portions with each other, whereby the peripheral edge of the diaphragm is hermetically fixed to the inner surface of the inner space. This arrangement facilitates the assembly of the pressure switch of the present invention.

In the pressure switch according to the present invention, it is more preferable that an equalizing hole is formed in the housing to communicate the switch mechanism chamber with the outside space. The equalizing hole ensures normal operation of the switch mechanism in the switch mechanism chamber when the pressure of the fluid in the pressurized fluid operating chamber is at a predetermined set level.

One embodiment of the present invention will now be described in detail with reference to the accompanying drawings of FIGS. 4 to 6.

DETAILED DESCRIPTION OF THE PREFERRED EMBODIMENTS

Figure 4:
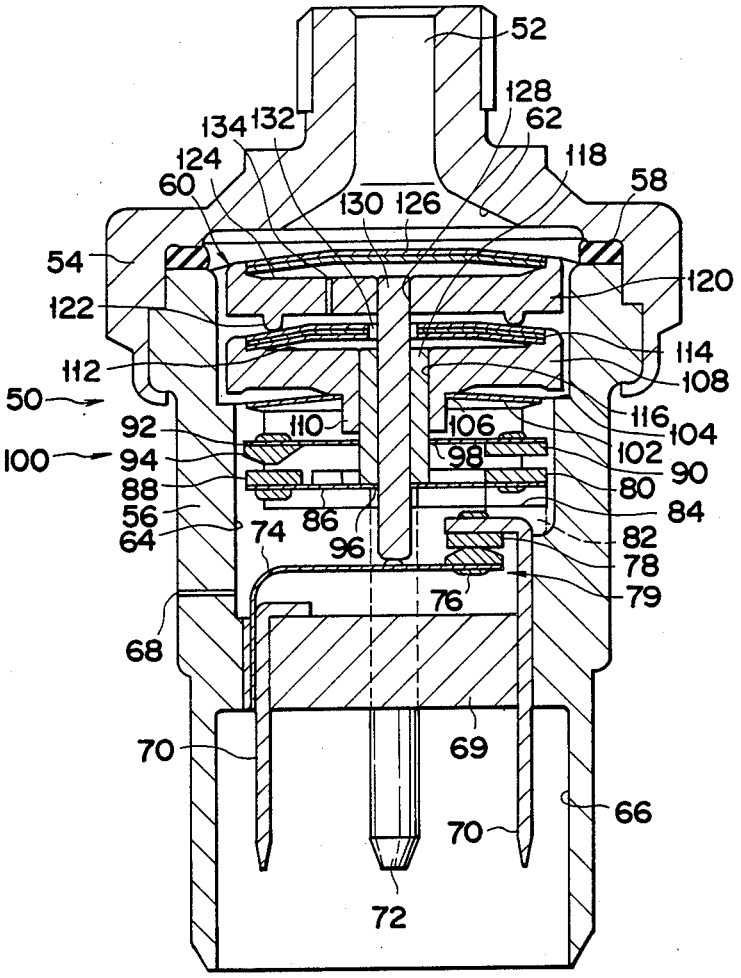
FIG. 4 is a longitudinal sectional view schematically showing an arrangement of a triple-action pressure switch according to one embodiment of the present invention.

FIG. 4 schematically shows a longitudinal section of a triple-action pressure switch according to one embodiment of the present invention used in a refrigeration system, which employs the R22 ($CHClF_2$) as a refrigerant.

In the following descriptions, all the pressure values represent gage pressures.

In FIG. 4, reference numeral 50 designates a housing which has an inner space. Housing 50 includes first and second half portions 54 and 56. First half portion 54 is made of metal (aluminum alloy 6063 in this embodiment), and has pressurized fluid inlet hole 52 through which a pressurized fluid is introduced into the inner space. Second half portion 56 is coupled to an open end of portion 54 by crimping. Although second half portion 56 is not expected to be airtight, it should preferably be free from penetration of water. In this embodiment, portion 56 is formed of glass-fiber-reinforced polybutylene terephthalate (more specifically, polybutylene terephthalate resin containing 30% of glass fiber; PBT with 30% GF).

The inner space of housing 50 is divided in two by means of diaphragm 60, whose peripheral edge is supported by ring-shaped packing (elastic seal member) 58 formed of chloroprene rubber. Packing 58 is sandwiched between the respective open ends of first and second half portions 54 and 56. One of the two divisions constitutes pressurized fluid operating chamber 62, which communicates with pressurized fluid inlet hole 52, in first half portion 54. The other division constitutes switch mechanism chamber 64, which is airtightly separated from operating chamber 62 of first half portion 56 by means of diaphragm 60, in second half portion 56.

Figure 1:
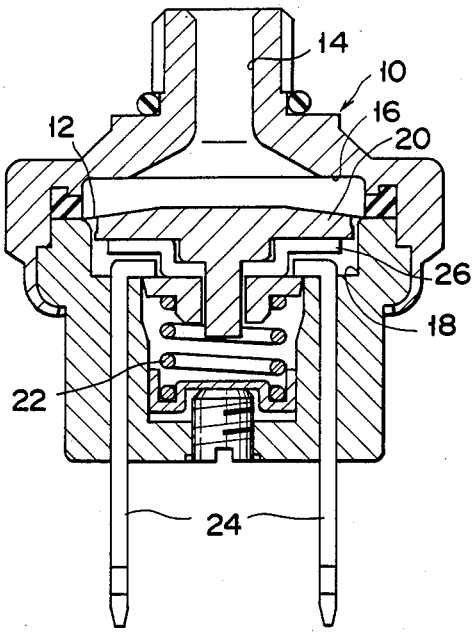
FIG. 1 PRIOR ART
FIG. 1 is a longitudinal sectional view schematically showing an arrangement of a typical conventional pressure switch of a low-pressure-cut off type.
Figure 2:
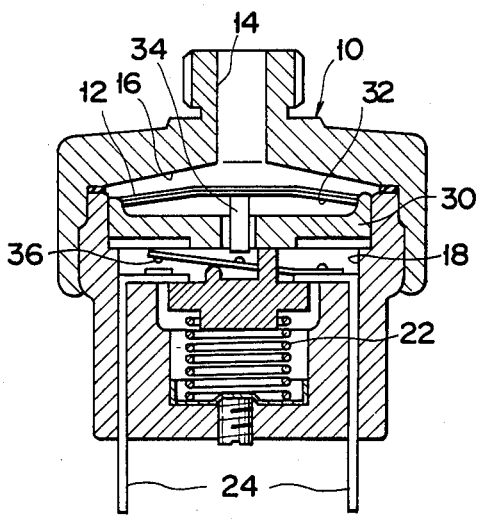
FIG. 2 PRIOR ART
FIG. 2 is a longitudinal sectional view schematically showing an arrangement of a typical conventional pressure switch of a double-action type, which is constructed by combining the construction for the low-pressure-cut off type described above and the construction for a high-pressure-cut off type.
Figure 3:
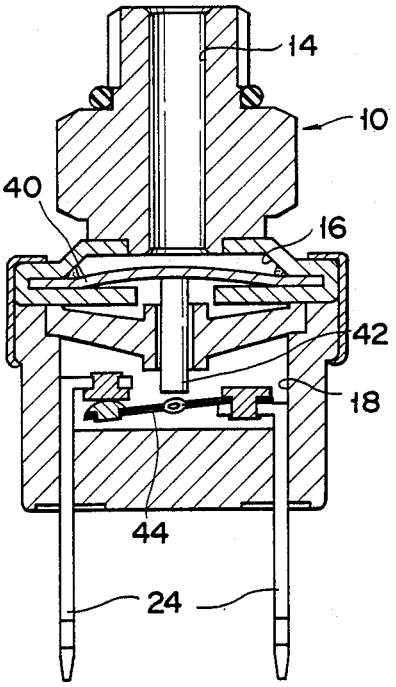
FIG. 3 PRIOR ART
FIG. 3 is a longitudinal sectional view schematically showing an arrangement of a pressure switch conventionally used in a refrigeration system employing the R22, R502, or R500 as a refrigerant.
Figure 5:
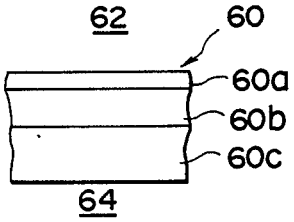
FIG. 5 is an enlarged side view showing part of a lateral face of a diaphragm used in the triple-action pressure switch of FIG. 4.

As shown in detail in FIG. 5, diaphragm 60 is composed of metal film 60*a*, friction reducing film 60*b*, and plastic film 60*c*, which are stacked in layers. These three films are illustrated as in intimate contact state, but they can be transformed independently. Films 60*a*, 60*b* and 60*c* are formed of thin films of austenite stainless steel (SUS304L), polytetrafluoroethylene, and polyimide, respectively.

The thickness of metal film 60*a* and the combined thickness of friction reducing film 60*b* and plastic film 60*c* are so set that stress produced in film 60*a* when film 60*a* is elastically transformed with the transformation of diaphragm 60 is smaller than stress produced in films 60*b* and 60*c* when films 60*b* and 60*c* are elastically transformed with the transformation of diaphragm 60. This specific requirement, related to the thickness of metal film 60*a* and the combined thickness of friction reducing film 60*b* and plastic film 60*c*, can be fulfilled by making the ratio between the thickness of film 60*a* and the combined thickness of films 60*b* and 60*c* smaller than the inverse number (about $\frac{1}{4}$) of the cube root of the ratio between the modulus of longitudinal elasticity ($20\times10^{10}$ Pa) of film 60*a* and the combined modulus of longitudinal elasticity ($0.3\times10^{10}$ Pa) of films 60*b* and 60*c*. In this embodiment, the thickness of metal film 60*a* is 10 micrometers, while the combined thickness of friction reducing film 60*b* and plastic film 60*c* is 75 micrometers, so that the aforesaid ratio in thickness is 1/7.

Diaphragm 60, having the aforementioned three-layer structure, is located in the inner space of housing 50 to face metal film 60*a* with pressurized fluid operating chamber 62 and to face plastic film 60*c* with switch mechanism chamber 64, respectively.

Hollow 66 is formed in the end surface of second half portion 56, the end surface being located away from first half portion 54. The hollow is in alignment with pressurized fluid inlet hole 52 and pressurized fluid operating chamber 62 of first portion 54 and switch mechanism chamber 64 of second portion 56 in the axial direction of housing 50.

Equalizing hole 68 is formed in the peripheral wall of second half portion 56, through which switch mechanism chamber 64 communicates with the outside space. Hole 68 serves effectively to prevent the pressure of the fluid (atmosphere) in chamber 64 from varying due to temperature change of the outside air or a leakage of a small amount of refrigerant through diaphragm 60 or packing (elastic seal member) 58, such refrigerant leakage not influencing normal action of the refrigeration system. Normally, however, hole 68 is closed by means of a plug (not shown) to prevent humidity of the atmosphere from entering switch mechanism chamber 64. The plug is formed of polytetrafluoroethylene which ensures good sliding capability.

Two pairs of terminal members 70 and 72 penetrate partition wall 69, located between hollow 66 and switch mechanism chamber 64, at four circumferential positions at regular intervals to project two opposite ends of each terminal member individually into hollow 66 and chamber 64.

The proximal end portions of one pair of terminal members 70 in switch mechanism chamber 64 are formed to have a lower height from partition wall 69 than those of the other pair of terminal members 72 in chamber 64. In FIG. 4, only one of the other pair of terminal members 72 is illustrated.

As shown in FIG. 4, the proximal end portion of one of one pair of terminal members 70 is bent along the inner surface of partition wall 69. The proximal end portion of the other terminal member 70 projects further inwardly from the inner surface of partition wall 69 and then, the inwardly extending end is bent to face the inner surface of partition wall 69 One end of first resilient switch segment 74 formed of a material having electrical conductivity and resiliency is fixed to the proximal end portion of one terminal member 70. The other end of first resilient switch segment 74 extends further inwardly from the inner surface of partition wall 69 and then is bent to extend along the inner surface of partition wall 69 to a position located under the inwardly extending end of the other terminal member 70. Contact 76 is fixed to the other end of first resilient switch segment 74, and contact 78 is fixed to the inwardly extending end of the other terminal member 70 so that contact 78 contact contact 76 of the other end of first resilient switch segment 74 from the above. First resilient switch segment 74 and the inwardly extending end of the other terminal member 70 constitute second switch means 79 for performing a predetermined action to be described later.

In switch mechanism chamber 64, one of the proximal end portions of the other pair of terminal members 72 extends above the inner surface of partition wall 69 in a direction parallel to a straight line connecting the proximal end portions of one par of terminal members 70 at a position above the proximal end portions of one pair of terminal members 70. Extending end 80 of the proximal end portion reaches a position near the inner peripheral surface of switch mechanism storage chamber 64. Support segment 82 bent toward partition wall 69 is formed on extending end 80. Support segment 82 is inserted and supported in a support recess on stepped support portion 84 formed on the inner peripheral surface of switch mechanism chamber 64. One end of second resilient switch segment 86 is fixed to extending end 80 and the other end of second resilient switch segment 86 extends to be parallel to first resilient switch segment 74 above first resilient switch segment 74. Second resilient switch segment 86 is formed of a material having electrical conductivity and resiliency. Contact 88 is fixed to the other end of second resilient switch segment 86 to face in an opposite direction to the bottom surface (i.e., the inner surface of partition wall 69) of switch mechanism storage chamber 64.

In switch mechanism chamber 64, the other proximal end portion of the other pair of terminal members 72 extends above the inner surface of partition wall 69 in a direction parallel to a straight line connecting the proximal end portions of one pair of terminal members 70 at a position above the proximal end portions of one pair of terminal members 70. A support segment (not shown) bent toward partition wall 69 is formed on extending end 90 of the proximal end portion of the other terminal member 72. This support segment is also inserted and supported in a support recess formed on stepped support portion 84 formed on the inner peripheral surface of switch mechanism chamber 64. One end of third resilient switch segment 92 is fixed to extending end 90, and the other end of third resilient switch segment 92 extends along second resilient switch segment 86 above second resilient switch segment 86. Third resilient switch segment 92 is also formed of a material having electrical conductivity and resiliency. Contact 94 is fixed to the other end of third resilient switch segment 92 to face contact 88 fixed at the other end of second resilient switch segment 86.

Elongated through hole 96 is formed in the middle portion of second resilient switch segment 86 with its major axis extending in the longitudinal direction of segment 86. Elongated through hole 98 is formed in the middle portion of third resilient switch segment 92 with its major axis extending in the longitudinal direction of segment 92. Through hole 96 is coaxial with through hole 98, but the diameter of through hole 98 of third resilient switch segment 92 is larger than that of through hole 96 of second resilient switch segment 86.

Second and third resilient switch segments 86 and 92 having the arrangement and structure as described above cooperate to constitute first switch means 100 for performing a predetermined action (to be described later).

In switch mechanism chamber 64 of second half portion 56, first snap disc means 102 is arranged above third resilient switch segment 92 (nearer to diaphragm 60 than to third resilient switch segment 92). In this embodiment, first snap disc means 102 is constituted by a single snap disc. The periphery of first snap disc means 102 is placed in a small notch of an inner peripheral edge of substantially annular stepped portion 104 formed on the inner peripheral surface of switch mechanism chamber 64 above third resilient switch segment 92. In FIG. 4, the central portion of first snap disc means 102 projects upward, and through hole 106 is formed in its central portion.

In switch mechanism chamber 64 of second half portion 56, second piston member 108 is arranged above first snap disc means 102. Second piston member 108 is slidable in the axial direction of second housing portion 56 in a large-diameter region of the inner peripheral surface of switch mechanism chamber 64, and is supported by the upper projecting central portion of first snap disc means 102. The peripheral portion of the lower surface of second piston member 108 is separated upward from stepped portion 104 by a predetermined distance. Low-pressurE actuating projection 110 is formed at the central portion of the lower surface. Projection 110 is inserted in through hole 106 formed at the central portion of first snap disc means 102, and extends to approach the upper surface of third resilient switch segment 92.

Shallow circular receiving recess 112 having a flat bottom surface is formed in the upper surface of second piston member 108. Second snap disc means 114 having substantially the same diameter as that of receiving recess 112 is arranged in receiving recess 112. In this embodiment, second snap disc means 114 is constituted by three snap discs. The three snap discs are stacked with a lubricant containing solid molybdenum disulfide being pasted therebetween to allow smooth movement therebetween. In FIG. 4, the center portion of second snap disc means 114 projects upward.

Guide hole 116 is formed at the central portion of second piston member 108 to extend in the axial direction of second piston member 108. Upper end of guide hole 116 is open at the central portion of receiving recess 112 on the upper surface of the second piston member 108 and the lower end thereof is open at the end face of low-pressure actuating projection 110 on the lower surface of second piston member 108.

Tubular first actuating rod 118 is inserted in guide hole 116. First actuating rod 118 is slidable in guide hole 116 in its axial direction. The lower end of first actuating rod 118 is inserted in through hole 98 formed in the central portion of third resilient switch segment 92, and abuts against the upper surface of second resilient switch 86 at tHe periphery of through hole 96. First actuating rod 118 is formed of a light material so as not to substantially flex second resilient switch segment 86 and so as to reliably transmit deformation due to a snap effect (to be described later) of second snap disc means 114 to second elastic switch segment 86 without causing self deformation.

In switch mechanism chamber 64 of second half portion 56, first piston member 120 is arranged above second snap disc means 114. First piston member 120 is slidable in the axial direction of second half portion 56 in the large-diameter region of the inner peripheral surface of switch mechanism chamber 64, and is supported on the upper projecting central portion of second snap disc means 114 by annular support projection 122 which is formed on the lower surface of piston member 120 to be concentrical with the central) axis of second half portion 56.

The upper surface of first piston member 120 abuts against diaphragm 60. Shallow circular receiving recess 124 having a flat bottom surface is formed on the upper surface. Third snap disc means 126 having substantially the same diameter as that of receiving recess 124 is arranged in receiving recess 124. In this embodiment, third snap disc means 126 is constituted by two snap discs. The two snap discs are stacked with a lubricant containing solid molybdenum disulfide being pasted therebetween to allow smooth movement therebetween. In FIG. 4, the central portion of third snap disc means 126 projects upward.

Guide hole 128 extending in the axial direction of first piston member 120 is formed at the central portion of first piston member 120. One end of guide hole 128 is open at the central portion of receiving recess 124 on the upper surface of first piston member 120, and the other end of guide hole 128 is open it the central portion of the lower surface of first piston member 120.

Second actuating rod 130 is inserted in guide hole 128. Second actuating rod 130 is slidable in guide hole 128 in its axial direction. The lower end portion of second actuating rod 130 is inserted in through hole 132 at the central portion of second snap disc means 104, is then inserted in a central hole of first actuating rod 118, is finally inserted in through hole 96 formed in the central portion of second resilient switch segment 86, and abuts against the upper surface of first resilient switch segment 74. Second actuating rod 130 is formed of a material so as not to substantially flex first resilient switch segment 74 and so as to reliably transmit deformation due to a snap effect (to be described later) of third snap disc means 126 to first resilient switch segment 74 without causing self deformation.

Small hole 134 is formed in first piston member 120 to extend from the bottom surface of receiving recess 124 to the under surface of first piston member 120.

Small hole 134 securely prevents the pressure in receiving recess 124, closed at its opening by diaphragm 60, from being increased in a case that the refrigerant leaks from the refrigerant system not so much that refrigerant leakage does not influence normal action of the refrigeration system.

Needless to say, the increasing of pressure in receiving recess 124 prevents third snap disc means 126 from transforming at a predetermined pressure value, and prevents the pressure switch form acting in a desired state.

In the triple action pressure switch according to the embodiment of the present invention with the above arrangement, fluid inlet hole 52 is coupled to a pressurized fluid path such as a refrigerant path in a refrigeration system (not shown) of an automative air conditioner, and the externally projecting ends of the two pairs of terminal members 70 and 72 are electrically coupled to a socket member (not shown) inserted in hollow 66 of housing 50. The pair of terminal members 72 for first switch means 100 are connected to, e.g., an electrical circuit for a compressor in the refrigeration system. The pair of terminal members 70 for second switch means 79 are coupled to, e.g., an electrical circuit of a fan motor for a condenser of the refrigeration system.

When a pressure of a refrigerant in the refrigerant path increases and reaches 560 kPa, first snap disc means 102 which receives the pressure of the refrigerant introduced into fluid operating chamber 62 through diaphragm 60, third snap disc means 126, first piston member 120, second snap disc means 114, and second piston member 108, makes snap-transformation from a first configuration wherein its central portion projects upward as shown in FIG. 4 to a second configuration wherein its central portion projects downward. Such transformation of first snap disc means 102 causes downward sliding of second piston member 108 which receives the pressure of the refrigerant introduced into fluid operating chamber 62 through diaphragm 60, third snap disc means 126, first piston member 120, and second snap disc means 114.

Low-pressure actuating projection 110 of second piston member 108 slid downward presses third resilient switch segment 92 downward. Thus, contact 94 of third resilient switch segment 92 is brought into contact with contact 88 of second resilient switch segment 86. As a result, the electrical circuit of the compressor (not shown) is turned on.

The downward sliding of second piston member 108 is stopped since the peripheral portion of the lower surface thereof abuts against stepped portion 104 of second half portion 56. More specifically, stepped portion 104 serves as a piston member moving distance restricting means for restricting the downward moving distance o second piston member 108.

Since second piston member 108 abuts against stepped portion 104, first snap disc means 102 can be prevented from being excessively deformed due to an increase in pressure of the refrigerant to 560 kPa or more. As a result, even if the pressure of the refrigerant is increased to 560 kPa or more, first snap disc means 62 cannot be plastically deformed.

In this embodiment, when the pressure of the refrigerant is decreased to 330 kPa or less, first snap disc means 102 can be transformed from the second configuration wherein its central portion projects downward to the first configuration shown in FIG. 4 by the function of self resiliency and the resilient force accumulated on third resilient switch segment 92. Such transformation of first snap disc means 102 causes contact 94 of third resilient switch segment 92 to separate from contact 88 of second resilient switch segment 86, as shown in FIG. 4. As a result, the electrical circuit of the compressor (not shown) is turned off.

In this embodiment, until the pressure of the refrigerant is further increased and reaches 2.37 MPa, third snap disc means 126 is not transformed from a first configuration wherein its central portion projects upward as shown in FIG. 4 to a second configuration wherein its central portion projects downward. When first snap disc means 102 is in the second configuration wherein its central portion projects downward while third snap disc means 126 is in the first configuration wherein its central portion projects upward, i.e., until the pressure of the refrigerant is increased from 560 kPa to 2.37 MPa, the upper end of second actuating rod 130 projects into receiving recess 124 in the upper surface of first piston member 120, but a gap is formed between the lower surface of third snap disc means 126 whose central portion projects upward and the upper end of second actuating rod 130. Therefore, first resilient switch segment 74 will not be pressed by second actuating rod 130 to be curved downward such that contact 76 is separated from contact 78 fixed to the inwardly extending end of the proximal end portion of corresponding terminal member 70. As a result, the electrical circuit of the fan motor for the condenser (not shown) is kept ON. In this embodiment, when the electrical circuit for the fan motor of the condenser (not shown) is kept on, the fan motor (not shown) is not rotated.

When the increasing pressure of the refrigerant has reached 2.37 MPa, third snap disc means 126 makes snaptransformation from the first configuration wherein its central portion projects upward as shown in FIG. 4 to the second configuration wherein its central portion projects downward. The lower surface of the central portion of third snap disc means 126 which has been transformed to the second configuration presses second actuating rod 130 downward, and the second actuating rod 130 causes first resilient switch segment 74 to be curved downward so that contact 76 of first resilient switch segment 74 is separated from contact 78 fixed to the inwardly extending end of the proximal end portion of corresponding terminal member 70. By this motion, the electrical circuit for the fan motor of the condenser (not shown) is turned off. As a result, in this embodiment, the fan motor (not shown) is rotated to cool the condenser.

In this embodiment, when the pressure of the refrigerant is decreased to 1.80 MPa or less, third snap disc means 126 can be transformed from the second configuration wherein its central portion projects downward to the first configuration wherein its central portion projects upward, as shown in FIG. 4, by the function of the self resiliency and the resilient force accumulated on first resilient switch segment 74. Such transformation of third snap disc means 126 causes contact 76 of first resilient switch segment 74 to abut against contact 78 of the inwardly extending end of the proximal end portion of corresponding terminal member 70, as shown in FIG. 4. In this manner, the electrical circuit of the fan motor for the condenser (not shown) is turned on. As a result, in this embodiment rotation of the fan motor for cooling the condenser (not shown) is stopped.

In this embodiment, until the pressure of the refrigerant is further increased and reaches 3.9 MPa, second snap disc means 114 does not make transformation from the first configuration wherein its central portion projects upward as shown in FIG. 4 to the second configuration wherein its central portion projects downward. When the first snap disc means 102 is in the second configuration wherein its central portion projects downward while second snap disc means 114 is in the first configuration wherein its central portion projects upward, the upper end of first actuating rod 118 projects into receiving recess 112 in the upper surface of second piston member 108, but a gap is formed between the lower surface of second snap disc means 114 whose central portion projects upward, and the upper end of first actuating rod 118. Therefore, second resilient switch segment 86 will not be depressed by first actuating rod 118 to be curved downward such that contact 88 is separated from contact 94 of third resilient switch segment 92 which has been resiliently deformed to be curved downward, as described above. For this reason, the electrical circuit for the compressor (not shown) is kept ON.

When the increasing pressure of the refrigerant has reached 3.9 MPa, second snap disc means 114 makes snap-transformation from the first configuration wherein its central portion projects upward as shown in FIG. 4 to the second configuration wherein its central portion projects downward. The lower surface of the central portion of second snap disc means 114 which has been deformed to the second configuration presses first actuating rod 118 downward, and first actuating rod 118 causes second resilient switch segment 86 to be curved downward so that contact 88 is separated from contact 94 of third resilient switch segment 86 which has been curved downward as described above. As a result, the electrical circuit for the compressor (not shown) is turned off.

In this embodiment, when the pressure of the refrigerant decreases and has reached 2.8 MPa, second snap disc means 114 can be transformed from the second configuration wherein its central portion projects downward to the first configuration wherein its central portion projects upward, as shown in FIG. 4, by the function of the self resiliency and the resilient force accumulated on second resilient switch segment 86. Such transformation of second snap disc means 114 causes contact 88 of second resilient switch 86 to be in contact with contact 94 of third resilient switch segment 92 which has been curved downward, as described above. As a result, the electrical circuit for the compressor (not shown) is turned on.

Figure 6:
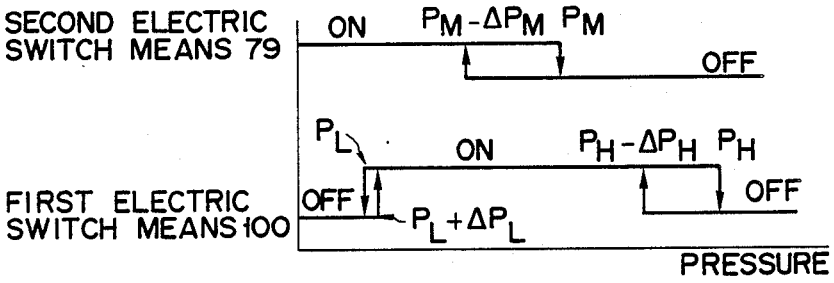
FIG. 6 is a diagram schematically showing the operating performances of first and second electric switch means of the triple-action pressure switch of FIG. 4, based on the pressure of a pressurized fluid.

FIG. 6 schematically shows the action characteristics of first and second switch means 100 and 79 in the triple-action switch apparatus of the above-mentioned embodiment in correspondence with a change in pressure of the refrigerant.

In FIG. 6, point PL indicates 3.30 kPa; PLΔPL, 560 kPa; PMΔPM, 1.80 MPa; PM, 2.37 MPa; PHΔPH, 2.8 MPa; and PH, 3.9 MPa.

PLΔPL indicates a value when first electric switch means 100 is turned on for the first time while the pressure of the refrigerant is increased. PL and PH respectively indicate upper- and lower-limit values when the first electric switch means 100 is turned off after it is temporarily turned on. PHΔPH indicates a value when first electric switch means 60 is turned on again after the pressure of the refrigerant is increased to PH or more as the upper-limit value and first electric switch means 100 is temporarily turned off.

More specifically, once the increasing pressure of the refrigerant has reached PLΔPL and first electric switch means 100 is turned on, switch means 100 is turned off only when the pressure of the refrigerant is decreased or increased to fall outside a predetermined range whose upper and lower limits are determined by PH and PL, respectively.

It is to be understood that the present invention is not limited to the embodiment described above, and that various changes and modifications may be effected therein by one skilled in the art without departing from the scope or spirit of the invention.

For example, metal film 60*a* of diaphragm 60 may alternatively be formed of a beryllium-copper alloy or bronze-based copper alloy, both of which have high corrosion-resistance to various refrigerants.

Moreover, plastic film 60*c* of diaphragm 60 may alternatively be formed of polyphenylene sulfide, which has good tensile strength and thermal resistance.

The material of packing 58 for diaphragm 60 is expected to have high corrosion resistance to the refrigerant used in the refrigeration system to which the pressure switch is applied. Recommendable examples of such material include nitrile-butadiene rubber (NBR), vinylidene-fluoride rubber, tetrafluoroethylenepropylene rubber, and silicon-fluoride rubber, as well as chloroprene rubber.

A film, made by coating metal on both surfaces or one surface of a polyamide film (such as, nylon 6 and nylon 66) having a small permeability to fron gas, may be used instead of the metal film. In this case, the polyamide resin film only functions as a base for metal coating. Instead of the polyamide resin film, a polyester resin film also may be used for a metal coating base.

What is claimed is:

1. A pressure switch comprising: a housing having an inner space and a pressurized fluid inlet hole for communicating the inner space with the outside space; a switch mechanism disposed in the inner space of the housing; a flexible diaphragm disposed between the pressurized fluid inlet hole and the switch mechanism in the inner space of the housing to divide the inner space into a pressurized fluid operating chamber, communicating with the pressurized fluid inlet hole, and a switch mechanism chamber, containing the switch mechanism and not communicating with the pressurized fluid inlet hole; and an elastic seal member disposed in the inner space and hermetically fixing the peripheral edge of the diaphragm to the inner surface of the inner space of the housing;

wherein:

said switch mechanism includes urging means for urging the diaphragm toward the pressurized fluid operating chamber, and the switch mechanism is turned on or off as the diaphragm is transformed against the urging force of the urging means by means of the pressure of a fluid introduced through the pressurized fluid inlet hole into the pressurized fluid operating chamber;

said diaphragm is constructed by stacking a metal film and a flexible plastic film in layers so that the films are independent of each other;

said diaphragm, whose peripheral edge is fixed to the inner surface of the inner space of the housing is so located that the metal film faces the pressurized fluid operating chamber and the plastic film faces the switch mechanism chamber; and the respective thicknesses of said metal film and said plastic film are so set that stress produced in the metal film when the metal film is elastically transformed by the transformation of the diaphragm is smaller than stress produced in the plastic film when the plastic film is elastically transformed by the transformation of the diaphragm:

wherein an equalizing hole is formed in the housing and connects the switch mechanism chamber with the outside space.

2. The pressure switch according to claim 1, wherein said diaphragm includes friction reducing means disposed between the metal film and the plastic film and serving to reduce friction between the films.

3. The pressure switch according to claim 2, wherein said plastic film is formed of a polyimide film, and said friction reducing means is formed of a polytetrafluoroethylene film, and the polytetrafluoroethylene film is sandwiched between the metal film and the polyimide film.

4. The pressure switch according to claim 1, wherein the ratio between the respective thicknesses of said metal film and said plastic film is smaller than the inverse number of the cube root of the ratio between the respective modulus of longitudinal elasticity of the metal film and the plastic film.

5. The pressure switch according to claim 1, wherein said housing includes first and second half portions, said first half portion having the pressurized fluid inlet hole and an inner space communicating with the inlet hole and opening at one end, said inner space of the first half portion constituting the pressurized fluid operating chamber, and said second half portion having an inner space open at one end and constituting the switch mechanism chamber; and said elastic seal member, supporting the peripheral edge of the diaphragm, is sandwiched between the respective open ends of the first and second half portions, and the elastic seal member is fixed on the inner surface of the inner space of housing between the pressurized fluid operating chamber and the switch mechanism chamber by connecting the first and second half portions with each other, whereby the peripheral edge of the diaphragm is hermetically fixed to the inner surface of the inner space.

6. A pressure switch including first switch means which is set in one of ON and OFF states when a pressure of a pressurized fluid is set within a predetermined range, and is set in the other of the ON and OF states when the pressure of the pressurized fluid is decreased below a lower limit of the predetermined range and is increased over an upper limit of the predetermined range, and second switch means which is set in one of the ON and OFF states when the pressure of the pressurized fluid is set to be larger than a predetermined value within the predetermined range, and is set in the other of the ON and OFF states when the pressure of the pressurized fluid is decreased below the predetermined value, said pressure switch functioning as a triple-action pressure switch, comprising:

a housing having an inner space and a hole for introducing the pressurized fluid into said inner space;

a diaphragm which is provided in said inner space so that said inner space of said housing is partitioned into a pressurized fluid operating chamber communicating with said pressurized fluid inlet hole and a switch mechanism chamber blocked from said pressurized fluid inlet hole in a sealed state, said diaphragm being constructed by stacking a metal film and a flexible plastic film in layers so that the films are independent of each other, said diaphragm, whose peripheral edge is fixed to the inner surface of the inner space of the housing being so located that the metal film faces the pressurized fluid operating chamber and the plastic film faces the switch mechanism chamber, and the respective thickness of said metal film and said plastic film being so set that stress produced in the metal film when the metal film is elastically transformed by the transformation of the diaphragm is smaller than stress produced in the plastic film when the plastic film is elastically transformed by the transformation of the diaphragm;

a first piston member which is arranged adjacent to said diaphragm in said switch mechanism chamber, and is moved together with a central portion of said diaphragm in a moving direction of said central portion when said central portion is moved upon transformation of said diaphragm;

a second piston member which is arranged adjacent to said first piston member at a side farther from said diaphragm in said switch mechanism chamber, and is moved together with said first piston member in a moving direction of said first piston member when said first piston member is moved upon transformation of said diaphragm;

first snap disc means which is arranged adjacent to a side surface of said second piston member farther from said first piston member in said switch mechanism chamber, a peripheral portion of which is supported by a peripheral surface of said switch mechanism chamber so as not to be moved away from said diaphragm in the moving direction of said second piston member, and which is transformable with a snap action between a first configuration wherein its central portion projects toward said diaphragm to cause said second piston member to move close to said diaphragm and a second configuration wherein its central portion projects in a direction away from said diaphragm to cause said second piston member to be moved inwardly in the moving direction in said switch mechanism chamber, said first snap disc means being in the first configuration until the pressure of the pressurized fluid transmitted through said diaphragm and said first and second piston members is increased from the lower limit of the predetermined range by a further predetermined value while the pressure of the pressurized fluid is increased, said first snap disc means being transformed from the first configuration to the second configuration when the pressure of the pressurized fluid is increased from the lower limit of the predetermined range by a further predetermined value, and when the pressure of the pressurized fluid is decreased after said first snap disc means was once transformed to the second configuration, said first snap disc means being transformed from the second configuration to the first configuration when the decreasing pressure of the pressurized fluid has reached the lower limit of the predetermined range;

second snap disc means which is interposed between said second and first piston members, and is transformable with a snap action between a first configuration wherein its central portion projects toward said first piston member and a second configuration wherein its central portion projects in a direction away from said first piston member, said second snap disc means being in the first configuration until the pressure of the pressurized fluid transmitted through said diaphragm and said first piston member reaches the upper limit of the predetermined range while the pressure of the pressurized fluid is increased, said second snap disk being transformed from the first configuration to the second configuration when the pressure of the pressurized fluid has reached the upper limit of the predetermined range, and when the pressure of the pressurized fluid is decreased after said second snap disc means is once transformed to the second configuration, said second snap disc means being transformed from the second configuration to the first configuration when the pressure of the pressurized fluid is decreased from the upper limit of the predetermined range by a further predetermined value;

third snap disc means which is interposed between said first piston member and said diaphragm and is transformable with a snap action between a first configuration wherein its central portion projects toward said diaphragm and a second configuration wherein its central portion projects in a direction away from said diaphragm, said third snap disc means being in the first configuration until the pressure of the pressurized fluid transmitted through said diaphragm reaches a predetermined value in the predetermined range while the pressure of the pressurized fluid is increased, the first configuration to the second configuration when the increasing pressure of the pressurized fluid has reached the predetermined value, and when the pressure of the pressurized fluid is decreased after said third snap disc means is once transformed to the second configuration, said third snap disc means being transformed from the second configuration to the first configuration when the pressure of the pressurized fluid is decreased from the predetermined value by a predetermined value;

a first actuating rod which is inserted in said second piston member and said first snap disc means to be movable in the moving direction of said second piston member and is moved in the moving direction upon transformation of said second snap disc means between the first and second configurations; and a second actuating rod which is inserted in said first piston member, said second snap disc means, said second piston member; and said first snap disc means to be movable in the moving direction of said first piston member, and is moved in the moving direction upon transformation of said third snap disc means between the first and second configurations;

wherein said first switch means has a pair of resilient switch segments which are arranged further inwardly from said first snap disc means in the moving direction of said first and second piston members in said switch mechanism chamber, are formed of an electrically conductive material, and are separated from each other in the moving direction, said pair of resilient switch segments of said first switch means are separated from each other or are in contact with each other to be in one of the OFF and ON states until the pressure of the pressurized fluid is further increased from the lower limit of the predetermined range by the predetermined value while the pressure is increased, when the pressure of the pressurized fluid is increased from the lower limit of the predetermined range by the predetermined value and said first snap disc means is transformed from the first configuration to the second configuration, one of said pair of resilient switch segments is pressed by one of the transformed first snap disc means and said second piston member which is moved inwardly in said switch mechanism chamber upon transformation of said first snap disc means, so as to be resiliently transformed, and one resilient switch segment which is resiliently transformed is in contact with or separated from the other resilient switch segment to set the other one of the 0N and OFF states, when the pressure of the pressurized fluid is further increased over the upper limit of the predetermined range and said second snap disc means is transformed from the first configuration to the second configuration, said other resilient switch segment is pressed by said first actuating rod which is moved inwardly in said switch mechanism chamber upon transformation of said second snap disc means, so as to be resiliently transformed, and said other resilient switch segment which is resiliently transformed is again separated from or in contact with said one resilient switch segment which has been already resiliently transformed to set said one of the OFF and ON states, when the pressure of the compressed fluid is further decreased from the upper limit of the predetermined range by the predetermined value while the pressure of the pressurized fluid is decreased after said second snap disc means is transformed to the second configuration, said second snap disc means is transformed formed from the second configuration to the first configuration, so that said first actuating rod is allowed to be moved toward said diaphragm in said switch mechanism storage chamber, pressing of said other resilient switch segment by said first actuating rod is released, and said other resilient switch segment is in contact with or separated from said one resilient switch segment again to recover said other one of the ON and OFF states, and when the pressure of the pressurized fluid reaches the lower limit of the predetermined range while the pressure of the pressurized fluid is decreased after at least said first snap disc means is transformed to the second configuration, said first snap disc means is transformed from the second configuration to the first configuration, so that said second piston member is allowed to be moved toward said diaphragm in said switch mechanism storage chamber, pressing of said one resilient switch segment by one of said first snap disc means and said second piston member is released, and as a result, said one resilient switch segment is again separated or in contact with said other resilient switch segment to set said one of the OFF and ON states;

wherein said second switch means has at least one resilient switch segment which is arranged further inwardly from said first snap disc means in the moving direction of said first and second piston members in said switch mechanism chamber, and is formed of an electrically conductive material, said at least one resilient switch segment of said second switch means is set in one of the ON and OFF states when said third snap disc means is in the first configuration until the pressure of the pressurized fluid reaches the predetermined value in the predetermined range while the pressure is increased, when the increasing pressure of the pressurized fluid has reached the predetermined value and said third snap disc means is transformed from the first configuration to the second configuration, said at least one resilient switch segment is pressed by said second actuating rod which is moved inwardly in said switch mechanism chamber upon transformation of said third snap disc means, so as to be resiliently deformed, and said at least one switch segment which is resiliently transformed is set in said other one of the OFF and 0N states, when the pressure of the pressurized fluid is further decreased from the predetermined value by a further predetermined value while the pressure is decreased after said third snap disc means is once transformed to the second configuration, and said third snap disc means is transformed from the second configuration to the first configuration, said second actuating rod is allowed to be moved toward said diaphragm in said switch mechanism chamber upon transformation of said third snap disc means and pressing of said at least one resilient switch segment by said second actuating rod is released, so that said at least one resilient switch segment is recovered to said one of the ON and OFF states; and wherein said first and second switch means are electrically connected to the other end of each of two terminal means whose one end projects outside said housing.

7. The pressure switch according to claim 6, wherein said diaphragm includes friction reducing means disposed between the metal film and the plastic film and serving to reduce friction between the films.

8. The pressure switch according to claim 7, wherein said plastic film is formed of a polyimide film, and said friction reducing means is formed of a polytetrafluoroethylene film, and the polytetrafluoroethylene film is sandwiched between the metal film and the polyimide film.

9. The pressure switch according to claim 6, wherein said the ratio between the respective thicknesses of said metal film and said plastic film is smaller than the inverse number of the cube root of the ratio between the respective modulus of longitudinal elasticity of the metal film and the plastic film.

10. The pressure switch according to claim 6, wherein said housing includes first and second half portions, said first half portion having the pressurized fluid inlet hole and an inner space communicating with the inlet hole and opening at one end, said inner space of the first half portion constituting the pressurize fluid operating chamber, and said second half portion having an inner space open at one end and constituting the switch mechanism chamber; and said elastic seal member, supporting the peripheral edge of the diaphragm, is sandwiched between the respective open ends of the first and second half portions, and the elastic seal member is fixed on the inner surface of the inner space of housing between the pressurized fluid operating chamber and the switch mechanism chamber by connecting the first and second half portions with each other, whereby the peripheral edge of the diaphragm is hermetically fixed to the inner surface of the inner space.

11. The pressure switch according to claim 6, wherein an equalizing hole is formed in the housing to communicate the switch mechanism chamber with the outside space.

* * * * *

UNITED STATES PATENT AND TRADEMARK OFFICE

CERTIFICATE OF CORRECTION

PATENT NO. : 4,939,321

DATED : July 3, 1990

INVENTOR(S) : Hazime Tanaka, et al.

It is certified that error appears in the above identified patent and that said Letters Patent is hereby corrected as shown below:

Column 16, claim 6, line 27, please delete second occurrence of "the" and insert at line 28, as a new paragraph, the following: --said third snap disc means being transformed from the--

Signed and Sealed this

Fifth Day of November, 1991

*Attest:*

HARRY F. MANBECK, JR.

*Attesting Officer*

*Commissioner of Patents and Trademarks*